US005906131A

United States Patent [19]

Fisch

[11] Patent Number: 5,906,131

[45] Date of Patent: May 25, 1999

[54] INDEXING CONVEYER FOR A DIE TRANSFER SYSTEM HAVING COUNTERCYCLIC VIBRATION DAMPING ON THE TRANSFER BAR

[75] Inventor: Alfred C. Fisch, Clarkston, Mich.

[73] Assignee: Rapindex, Inc., Bloomfield Hills, Mich.

[21] Appl. No.: 08/786,970

[22] Filed: Jan. 24, 1997

[51] Int. Cl.[6] ..... B21D 43/05

[52] U.S. Cl. ..... 72/405.16; 72/405.11; 72/405.01; 198/621.1

[58] Field of Search ..... 72/405.16, 405.13, 72/405.11, 405.09, 405.01; 198/621.1–621.4

[56] References Cited

U.S. PATENT DOCUMENTS

| | | | |
|---|---|---|---|
| 4,198,845 | 4/1980 | Sofy | 72/421 |
| 4,651,866 | 3/1987 | Imanishi | 72/41 |
| 5,035,134 | 7/1991 | Fisch | 72/405 |
| 5,081,860 | 1/1992 | Rante | 72/405.13 |
| 5,136,874 | 8/1992 | Fisch | 72/405 |
| 5,390,525 | 2/1995 | Fisch | 72/405 |

FOREIGN PATENT DOCUMENTS

| | | | |
|---|---|---|---|
| 269875 | 9/1994 | Japan | 72/405.13 |

*Primary Examiner*—Daniel C. Crane
*Attorney, Agent, or Firm*—Reising, Ethington, Barnes, Kisselle, Learman & McCulloch, P.C.

[57] ABSTRACT

A die transfer system that includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a hollow tubular transfer bar having at least one hand for engaging workpieces. The transfer bar is operatively coupled to an arrangement for reciprocating the transfer bar in at least one direction relative to the lower die. A mass is resiliently suspended within the transfer bar for vibrating with the transfer bar out of phase to vibrations in the transfer bar, and thereby countercyclically damping vibrations in the transfer bar.

12 Claims, 3 Drawing Sheets

INDEXING CONVEYER FOR A DIE TRANSFER SYSTEM HAVING COUNTERCYCLIC VIBRATION DAMPING ON THE TRANSFER BAR

The present application is directed to die transfer systems, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of workpieces through the die stations, they possess the disadvantage that the workpiece must be formed in a linear array at spaced locations along the strip stock, leading to substantial inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are preseparated and fed as individual units of the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and reengagement with the workpieces at each of the individual die stations.

U.S. Pat. No. 5,136,874, assigned to the assignee hereof, discloses a die transfer system that includes a lower die, an upper die carried for reciprocal vertical movement toward and away from the lower die to perform at least one operation on a workpiece positioned therebetween, and a conveyor arrangement for sequentially conveying workpieces between the dies. The conveyor arrangement has a pair of conveyors disposed on opposite lateral sides of the lower die. Each conveyor includes a plurality of hands for gripping workpieces, with the hands being spaced from each other lengthwise of the conveyor by distances corresponding to stations of the die. Each conveyor and its associated hands are indexed in a longitudinal direction through the die between stations in synchronism with motion of the upper die. The hands are moved simultaneously in at least one direction perpendicular to the longitudinal indexing direction by a camshaft that extends through the stations along an axis parallel to the indexing direction. A cam is mounted on each camshaft for rotation with the camshaft in synchronism with motion of the upper die. A follower arrangement couples each cam to the hands of the associated conveyor, so that reciprocal rotation of the camshaft about its axis results in reciprocal motion of the hands in one or more directions lateral to the longitudinal direction of conveyance of workpieces through the die stations. The conveyor camshafts are rotated by cam-and-follower arrangements coupled to the upper die, or by electric servo motors controlled by a master controller.

U.S. application Ser. No. 08/549,329, now U.S. Pat. No. 5,680,787, issued Dec. 28, 1997, assigned to the assignee hereof, discloses a die transfer system that includes a camshaft having an axis of rotation parallel to the direction of movement of workpieces through the die system, a transfer bar parallel to the camshaft axis carrying a plurality of hands for engaging the workpieces, and a cam arrangement coupling the camshaft to the transfer bar for moving the transfer bar both horizontally and vertically orthogonal to the camshaft axis. The cam arrangement includes a cam arm coupled to the camshaft and having a pair of angularly spaced drive rollers mounted thereon. Separate horizontal and vertical cam follower slots are disposed adjacent to the cam arm for sequential driving engagement by the rollers on the cam arm, such that rotation of the camshaft and cam arm brings the rollers into sequential engagement with the cam follower slots for driving the transfer bar horizontally and vertically with respect to the lower die.

Although the die transfer systems and indexing conveyor arrangements disclosed in the noted patent and application address and overcome problems and deficiencies theretofore extant in the art, further improvements remain desirable. For example, the indexing conveyors disclosed in the noted patent and application, as well as conveyors of conventional designs, typically are constructed such that the ends of the transfer bars are cantilevered from the supports that couple the transfer bar to the reciprocation drives. The transfer bar ends thus are subject to cyclic vibrations during operation. It is a general object of the present invention to provide facility by means of which such vibrations, particularly vibrations in the vertical direction, are countercyclically damped at one or both ends of the transfer bar.

SUMMARY OF THE INVENTION

A die transfer system in accordance with one aspect of the present invention includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a transfer bar having at least one hand for engaging workpieces. The transfer bar is operatively coupled to an arrangement for reciprocating the transfer bar in at least one direction relative to the lower die. Means are carried by the transfer bar for countercyclically damping vibrations in the transfer bar. In the preferred embodiment of the invention, such countercyclic vibration-damping means comprises a mass resiliently suspended on the transfer bar for vibrating with the transfer bar out of phase to the vibrations in the transfer bar, and thereby countercyclically damping vibrations in the transfer bar.

A workpiece conveyor in accordance with a second aspect of the present invention includes an elongated transfer bar having at least one hand for engaging workpieces, a transfer drive operatively coupled to the transfer bar for reciprocating the transfer bar in the direction of its length, and preferably also in two directions orthogonal to its length, and means carried by the transfer bar for countercyclically damping vibrations in the transfer bar. The transfer bar in the preferred embodiment of the invention is of hollow tubular construction, and the vibration-damping means preferably comprises a mass resiliently suspended within the hollow tubular construction of the transfer bar. The resiliently suspended mass in the preferred embodiment of the invention comprises a pair of shoulder bolts extending through the transfer bar and the mass, and two pair of coil springs surrounding respective bolts and disposed in compression on opposite sides of the mass within the transfer bar. The shoulder bolts and springs are preferably oriented in the vertical direction for countercyclically damping vertical vibrations in the transfer bar.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
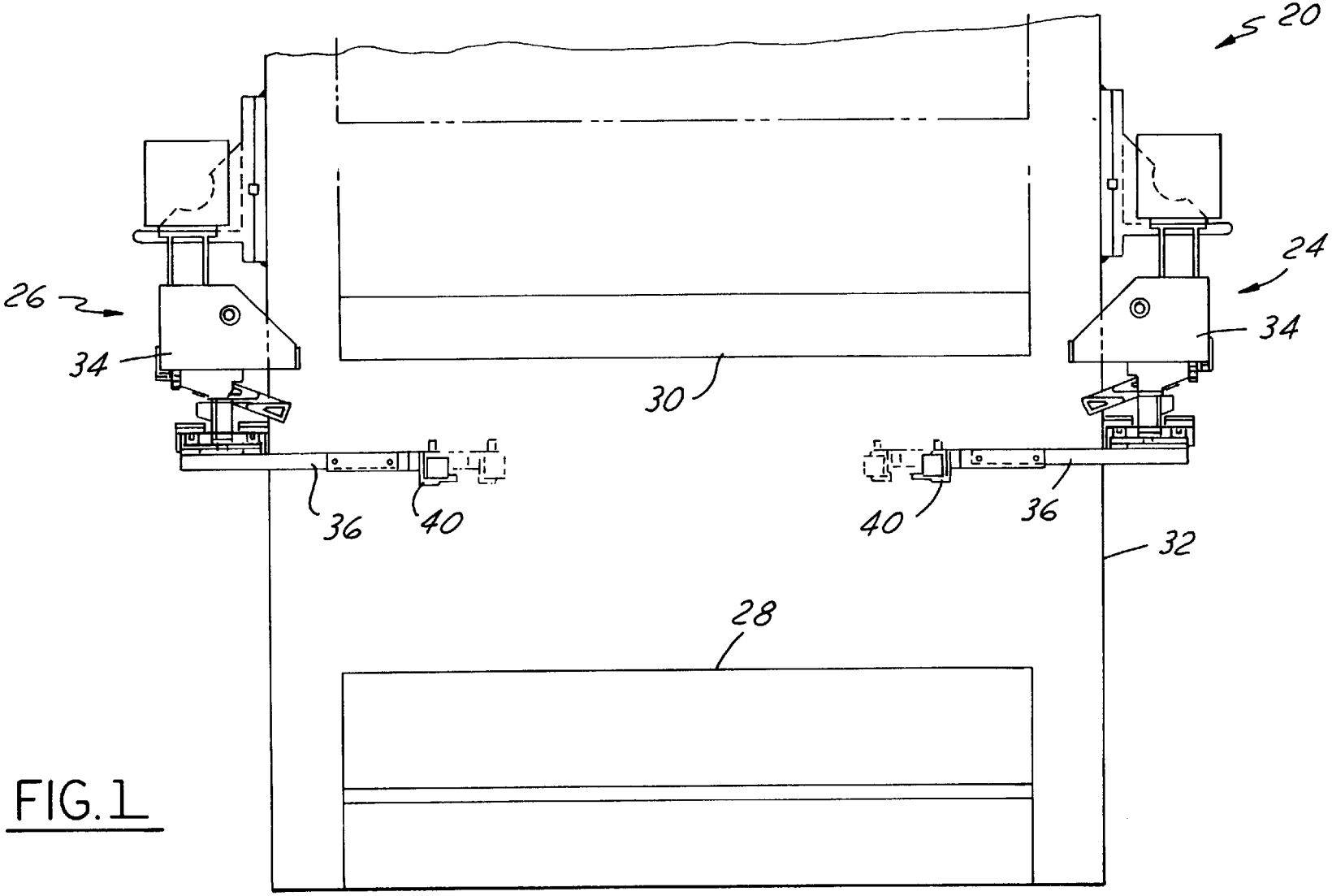
FIG. 1 is an end elevational view of a die transfer system in accordance with a presently preferred embodiment of the invention.
Figure 2:
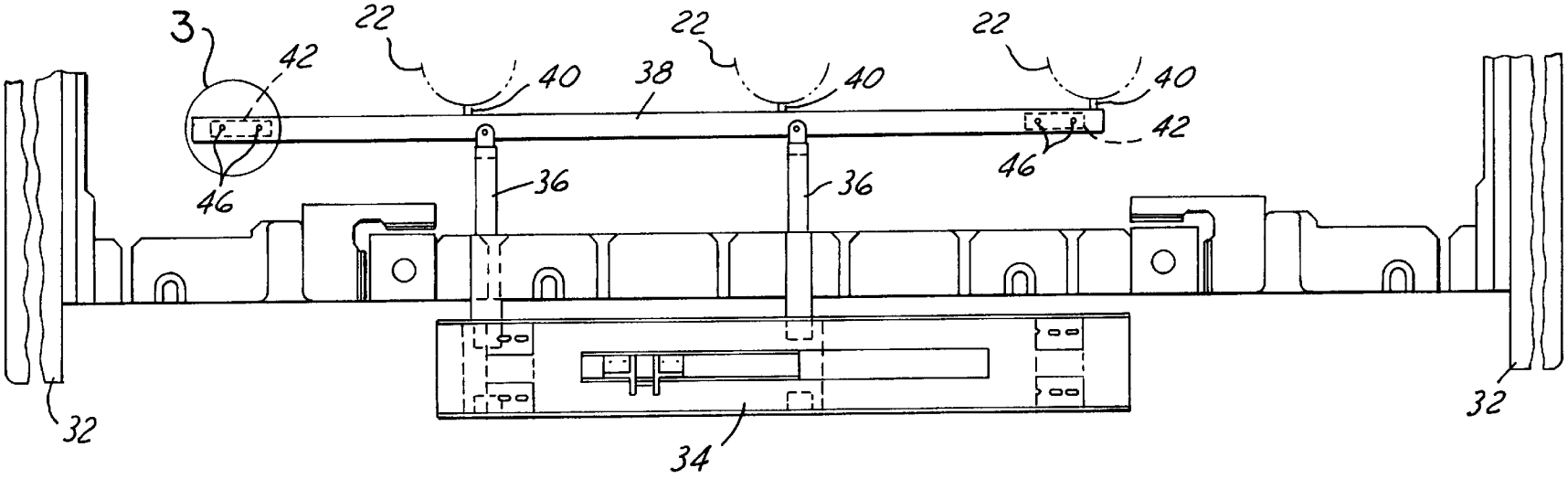
FIG. 2 is a top plan view of one of the conveyors illustrated in FIG. 1, the other conveyor in FIG. 1 being a mirror image of the conveyor in FIG. 2.

FIGS. 1 and 2 illustrate a die transfer system 20 in accordance with a presently preferred embodiment of the invention for indexing workpieces 22 through successive stations of a workpiece die. A pair of conveyors 24, 26 are positioned on laterally opposed sides of a lower die 28, and an upper die 30 is carried by a press support base 32 for vertical reciprocation with respect to lower die 28. In general, conveyors 24, 26 cooperate with the upper and lower dies to define a workpiece load station at the upstream end of the conveyors, an unload station at the downstream end of the conveyors, and one or more work stations positioned therebetween at which desired operations are performed on each workpiece 22 upon descent of the upper die. Details of the dies, the geometry of the workpieces and operations performed thereon by the dies are not directly germaine to the present invention. In general the constructions of conveyors 24, 26 are mirror images of each other. For some workpieces, only one conveyor 24 is required, and in other situations conveyor 24 may cooperate with another type of opposed transfer mechanism.

Each conveyor 24, 26 includes a conveyor drive mechanism 34 having opposed inwardly extending arms 36 that support an elongated transfer bar 38. Each transfer bar 38 preferably is of hollow tubular aluminum construction, and carries a plurality of longitudinally spaced hands 40 for engaging and supporting workpieces. Drive mechanisms 34 are constructed simultaneously to reciprocate transfer bars 30 in the direction of their lengths, and preferably also in horizontal and vertical directions orthogonal to their lengths. Most preferably, drive mechanisms 34 are as disclosed in above-noted U.S. application Ser. No. 08/549,329, now U.S. Pat. No. 5,680,787, the disclosure of which is incorporated herein by reference for additional detail relative to the drive mechanisms. One or both conveyors 24, 26 may be carried for swinging motion upwardly and outwardly with respect to lower die 28 for operator access to the lower die and/or conveyor, as disclosed in U.S. Pat. No. 5,390,525 assigned to the assignee hereof. Alternatively, one or both conveyors 24, 26 may be mounted on a wheeled cart as disclosed in U.S. Pat. No. 5,570,604, or may be fixedly mounted to the support base as disclosed in above-noted U.S. Pat. No. 5,136,874, both assigned to the assignee hereof.

As best seen in FIG. 2, each transfer bar 38 is carried by arms 36 in such a way that the opposed ends of the transfer bar are effectively cantilevered from arms 36. It has been found in some applications that cyclic motions imparted to each transfer bar 38 by associated drive mechanism 34 can cause cyclic vibrations at the cantilevered transfer bar ends, particularly in the vertical direction. Such vibrations can cause misoperation of the transfer conveyors. The present invention overcomes this problem by providing means at at least one and preferably both cantilevered ends of the transfer bar for countercyclically damping vibrations induced therein by operation of the transfer drive mechanism.

Figure 3:
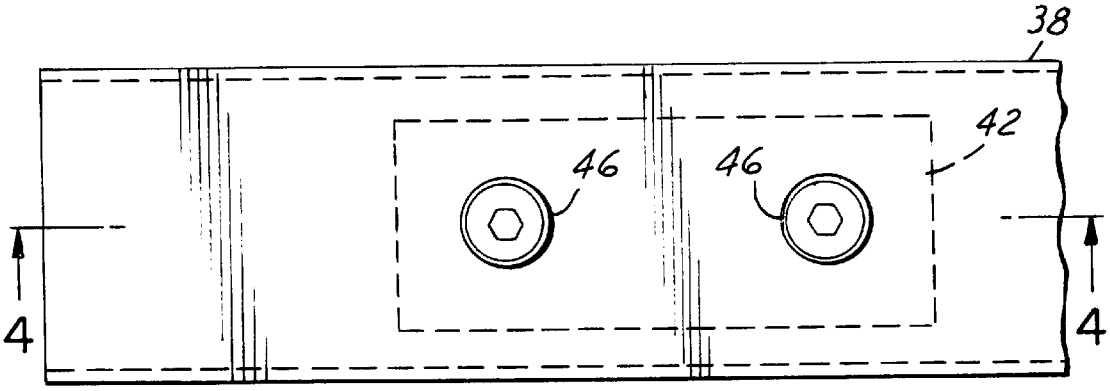
FIG. 3 is a fragmentary view on an enlarged scale of the portion of the conveyor within the circle 3 in FIG. 2.
Figure 4:
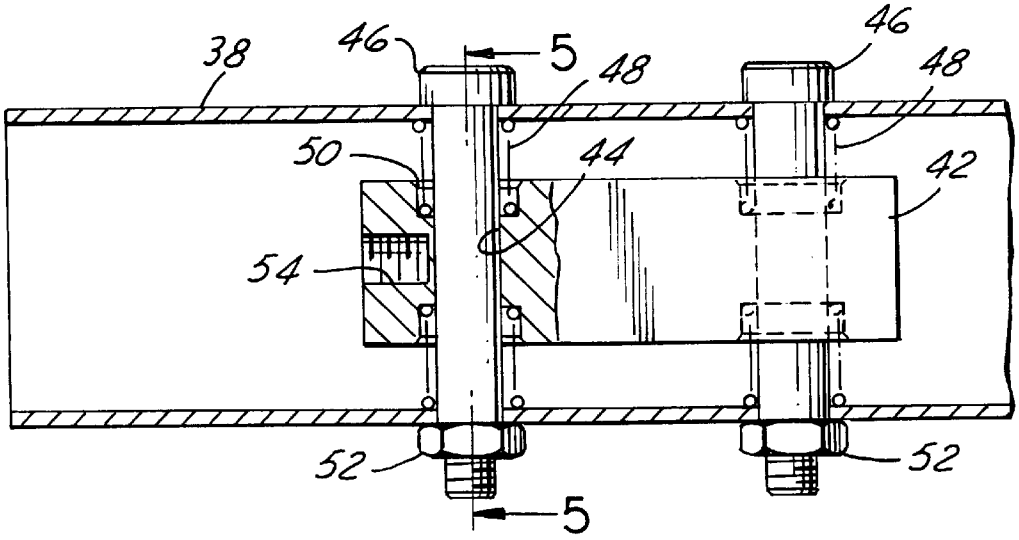
FIG. 4 is a fragmentary sectional view taken substantially along the line 4—4 in FIG. 3.
Figure 5:
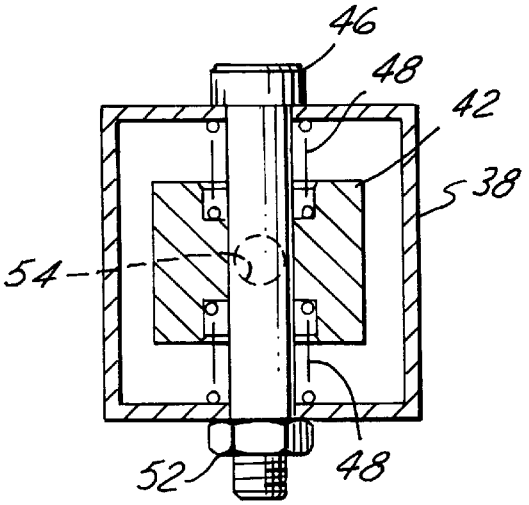
FIG. 5 is a sectional view taken substantially along the line 5—5 in FIG. 4.

Referring in particular to FIGS. 3–5, a rectangular mass 42 of metal or other relatively heavy composition is disposed within the rectangular tubular construction of transfer bar 38 adjacent to each end of the transfer bar. Mass 42 has a pair of spaced through-openings 44 that are slidably disposed on the shafts or shanks of a pair of longitudinally spaced vertically oriented shoulder bolts 46. A pair of coil springs 48 are disposed in compression surrounding each shoulder bolt 46, and between mass 42 and an opposing inner wall surfaces of transfer bar 38. Each coil spring 48 has one end positioned within a counterbore 50 on mass 42, and an opposing end that engages the interior surface of transfer bar 38. Shoulder bolts 46 are captured in assembly by nuts 52. A threaded opening 54 is provided at one end of mass 42 for assisting assembly of mass 42 and springs 48 with respect to shoulder bolts 46 within transfer bar 38.

Thus, each mass 42 disposed at an associated longituidinal end of transfer bar 38 is mounted by springs 48 and shoulder bolts 46 for countercyclically damping vertical vibrations induced in the transfer bar. That is, if a force is applied to transfer bar 38 causing motion of the same in the upward direction in FIGS. 4 and 5, the inertia of mass 42 causes additional compression of the lower coil springs 48 resisting such upward motion. Any subsequent downward motion of the transfer bar end releases such additional compression of the lower coil springs, but compresses the upper coil springs 48 to resist such downward motion. Thus, the inertia of mass 42 in combination with the spring constants of resilient springs 48 dampen such vibratory motion countercyclically—i.e., in inherent opposition to such vibratory motions. The weight of each mass 42 and/or the operating characteristics of springs 48 may be chosen analytically as a function of transfer bar design and operating cycle frequency, or empirically for best operation. In applications where horizontal vibration is a problem, masses 42, shoulder bolts 46 and springs 48 may be oriented horizontally, either in addition to or in place of the vertical orientation illustrated in the drawings.

I claim:

1. A die transfer system that includes lower die means, upper die means carried for reciprocal movement toward and away from said lower die means to perform at least one operation in a workpiece positioned therebetween, and means for sequentially conveying workpieces between said die means comprising:

a transfer bar having at least one means for engaging workpieces, means operatively coupled to said transfer bar for reciprocating said transfer bar in at least one direction relative to said lower die means, and a mass and means resiliently suspending said mass on said transfer bar for countercyclically damping vibrations in said transfer bar.

2. The system set forth in claim 1 wherein said transfer bar is of hollow tubular construction, and wherein said mass and said resiliently suspending means are disposed within said transfer bar.

3. The system set forth in claim 2 wherein said resiliently suspending means comprises at least one shaft extending through said transfer bar and said mass, and at least one pair of coil springs surrounding said shaft and disposed in compression on opposite sides of said mass within said transfer bar.

4. The system set forth in claim 3 wherein said at least one shaft comprises a pair of spaced shafts, and wherein said at least one pair of coil springs comprises two pairs of said springs surrounding respective ones of said shafts.

5. The system set forth in claim 4 wherein said shafts are oriented vertically for countercyclically damping vertical vibrations in said transfer bar.

6. The system set forth in claim 1 wherein said means for reciprocating said transfer bar is coupled to said transfer bar such that at least one end of said transfer bar is cantilevered from said reciprocating means, and wherein said mass and said resiliently suspending means are mounted at said at least one end of said transfer bar.

7. The system set forth in claim 6 wherein said transfer bar has two ends cantilevered from said reciprocating means, and wherein said vibration-damping means comprises a pair of said masses and means resiliently suspending said masses at opposed ends of said transfer bar.

8. A workpiece conveyor that comprises:

an elongated transfer bar of hollow tubular construction having at least one means for engaging workpieces, means operatively coupled to said transfer bar for reciprocating said transfer bar in the direction of its length, and means mounted within said hollow tubular construction of said transfer bar for countercyclically damping vibrations in said transfer bar.

9. The conveyor set forth in claim 8 wherein said vibration-damping means comprises a mass and means resiliently suspending said mass within said transfer bar.

10. The conveyor set forth in claim 9 wherein said mass and said resiliently suspending means are mounted at an end of said bar and oriented for countercyclically damping vertical vibrations in said bar.

11. The conveyor set forth in claim 10 wherein said resiliently suspending means comprises at least one shaft extending through said transfer bar and said mass, and at least one pair of coil springs surrounding said shaft and disposed in compression on opposite sides of said mass within said transfer bar.

12. The conveyor set forth in claim 11 wherein said at least one shaft comprises a pair of spaced shafts, and wherein said at least one pair of coil springs comprises two pairs of said springs surrounding respective ones of said shafts.

* * * * *